United States Patent [19]

Mustafa

[11] Patent Number: 5,049,844

[45] Date of Patent: Sep. 17, 1991

[54] ENCLOSED ELECTROMAGNETIC RELAY

[75] Inventor: Farid Mustafa, Rochester Hills, Mich.

[73] Assignee: Beta Mfg. Co., Warren, Mich.

[21] Appl. No.: 523,987

[22] Filed: May 16, 1990

[51] Int. Cl.[5] ..... H01H 3/00

[52] U.S. Cl. ..... 335/76; 335/128

[58] Field of Search ..... 335/78–86, 335/124, 128

[56] References Cited

U.S. PATENT DOCUMENTS 4,182,998 1/1980 Mueller ..... 335/78

*Primary Examiner*—Leo P. Picard
*Assistant Examiner*—Lincoln Donovan
*Attorney, Agent, or Firm*—Barnes, Kisselle, Raisch, Choate, Wittemore & Hulbert

[57] ABSTRACT

A relay comprising an electromagnetic coil wound on an insulating bobbin, the central cavity of which encloses a central spring-biased contact actuated by a magnetic armature in response to energization of the coil, to make or break contact with one or more fixed contacts also enclosed. A U-shaped member and a heel plate, both of highly magnetically permeable material, surround the coil and complete the magnetic circuit for flux generated by the coil. The magnetic armature is constructed and arranged such that it is accessible from the exterior of the enclosed relay to adjust the position of the spring-biased contact of the relay after it is assembled to conform with the desired level of voltage required to actuate the relay.

4 Claims, 2 Drawing Sheets

ENCLOSED ELECTROMAGNETIC RELAY

This invention relates in general to electromagnetically actuated relays, and more particularly to small dimensional relays adapted for use in conjunction with other electronic components on a printed circuit board, or for other applications.

BACKGROUND AND SUMMARY OF THE INVENTION

For many prior art applications requiring large numbers of highly reliable switching operations, such as in the telephone industry, it was customary to use reed relays comprising a pair of contacts sealed in an inert gas atmosphere into a glass tube. For operation, the latter was inserted into the gap of an electromagnetic coil. These reed relays were expensive to fabricate, required ferro-nickel material for the reeds which has a coefficient of thermal expansion equal to that of glass into which the ends were heat sealed. In order to carry a limited current, the contact ends were formed of precious metal diffused into the iron. Furthermore, the glass envelope was fragile, so that great care was required in fabricating and using such relays. Moreover, the relay resulting from insertion of the reed into the coil was magnetically inefficient without provision for a magnetic return path.

In U.S. Pat. No. 4,788,516, having a common assignee with the present invention, there is disclosed a miniature electromagnetically actuated relay in which the movable armature and contacts are completely encapsulated within the central cavity of the bobbin on which the electromagnet is wound. The latter, which is of elongated rectangular section, with the corners rounded, is surrounded, end-for-end, by a U-shaped strap and heel piece, both of magnetic material, which provide a return path for the magnetic flux generated by current passing through the electromagnet. The common contact disposed to move in the cavity of the bobbin between a pair of fixed, normally-open and normally-closed contacts, comprises a precious metal double-face button supported by a beryllium-copper spring carrying a steel armature. The spring for the common contact has its fixed end anchored to the external end of the bobbin in internal welded contact with the U-shaped strap, which is integrally formed with an externally-depending terminal. The normally-open and normally-closed contacts are respectively supported by metal strips attached to opposite walls of the internal cavity of the bobbin, positioned to engage the armature contact to open or close, depending on whether the electromagnet is energized or not. The normally-open and normally-closed contacts are also connected to externally-depending terminals. A pair of power terminals are respectively connected to opposite ends of the electromagnet coil. Thus, the fixed and movable contacts are all completely enclosed within the cavity of the insulating bobbin on which the electromagnet coil is wound.

When voltage is applied to the coil, current flows through it, generating a magnetic flux flowing through the central cavity in the direction of the axis of the coil. The total flux is a function of the voltage applied, the current generated, and the reluctance of the magnetic circuit. In the magnetic circuit, the flux flows through the U-shaped strap, the magnetic armature attached to the common terminal, the contacting pole face, and the magnetic heel piece. The flux generated between the armature and the pole face generates a force which attracts the armature to the pole face, thus causing the normally-closed contact to open, and closing the normally-open contact.

The switch has the advantage that placing the contact and armature mechanism inside permits the coil volume to assume a larger proportion of the total volume of the relay, than is the case in conventional prior art designs, in which an external pole piece is used, and the contact assembly is outside of the coil.

It has been found, using the switch that for a given voltage input a lower current can generate the same force, and thus, a given power input to the coil will run cooler, dissipating more heat, enabling the operation of the relay to be more efficient.

Furthermore, the use of edge lay and inlay material in the normally-open and normally-closed contact element provides flat contacts which can be precisely located in the bobbin, resulting in minimal need for adjustment.

Furthermore, the construction of the switch is such that the armature and all movable parts, and the contacts, are inside of the coil and are thus protected against dust and foreign particles. When the relay of the present invention is used on a printed circuit board in conjuction with other electronic components which require the use of a conformal coating to protect the elements against moisture, this relay resists entry of the coating material into the area of the armature and contacts, thus eliminating the necessity for the relay to have an additional protective cover.

The volume is smaller, the coil is smaller, and the relay operates cooler than in the case of prior art relays operating to produce commensurate amounts of magnetic flux.

Further, because the relay is constructed so that the contacts and armature are protected, the relay may be readily handled with less chance of damages, or need for adjustment.

By lengthening the bobbin and its cavity in a direction transversal to the axis of the electromagnet, a plurality of sets of normally-open and normally-closed contacts may be enclosed, for servicing a series of electrical circuits, which may be connected or electrically isolated.

A particular feature of the relay is the inclusion, in the internal cavity of the electromagnet, of a small permanent magnet of one of the magnetic materials well-known today, such as an alloy of aluminum, nickel and cobalt, known by the trademark ALNICO, or a magnetic ceramic, or another of the well-known permanent magnetic materials. This is disposed across the cavity of the bobbin, between the normally-open and normally-closed contacts, and electrically isolated therefrom, if the magnet itself is not an insulator. This permanent magnet serves to augment or oppose the flux generated in the coil, depending on the direction of the electromagnet current and the orientation of the magnetic poles of the permanent magnet.

The aforementioned construction is substantially like that of U.S. Pat. No. 4,788,516 incorporated herein by reference.

It has been found that a slight change in pickup voltage may occur after performing the last step in the assembly process. This step in the assembly process consists of staking the base to the frame which may affect the reluctance in the magnetic circuit and that may, in turn, affect the pickup voltage. Inasmuch as the relay is enclosed, there is no access to the interior to make any adjustment.

Accordingly, among the objectives of the present invention are to provide a construction whereby the small enclosed relay can be readily adjusted without disassembly; and which construction does not adversely affect the operation of the relay; which is inexpensive.

In accordance with the invention, the magnetic armature is constructed and arranged such that it is accessible from the exterior of the enclosed relay to adjust the relay after it is assembled to conform with the desired level of voltage required to actuate the relay. Specifically, the magnetic armature is provided with an opening extending to the exterior of the housing such that a small tool, such as a pin, can be inserted to move the armature and apply force laterally to change slightly the angular relationship of the flexible contact which is fixed to the armature and thereby adjust the voltage, while observing the voltage on an electronic instrument.

DESCRIPTION

Figure 1:
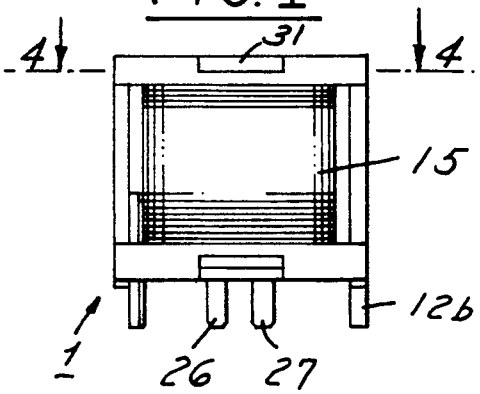
FIG. 1 is an elevational view of the relay.
Figure 3:
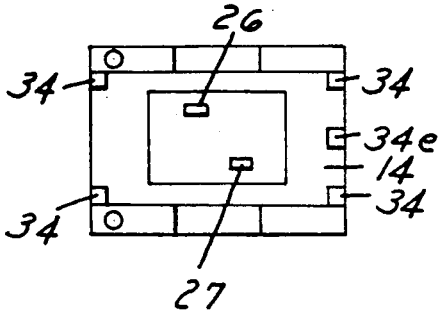
FIG. 3 is a bottom plan view of the relay.
Figure 2:
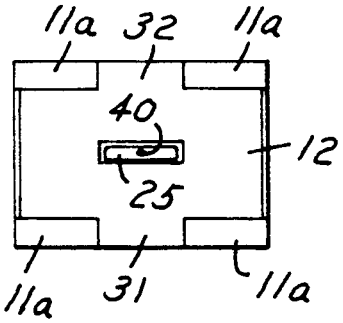
FIG. 2 is a top plan view of the relay.
Figure 6:
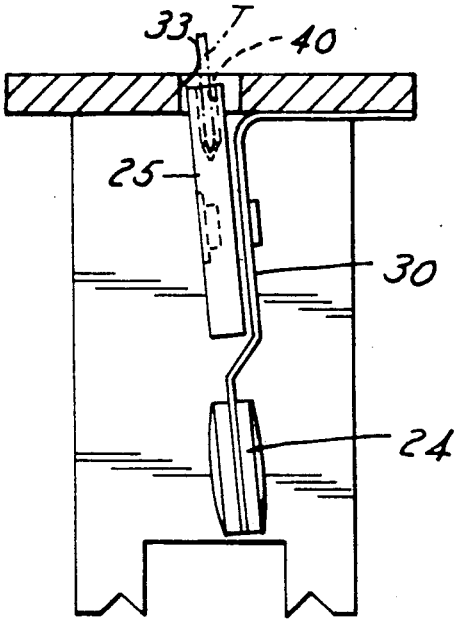
FIG. 6 is a fragmentary view of a portion of the relay shown in FIG. 5.
Figure 4:
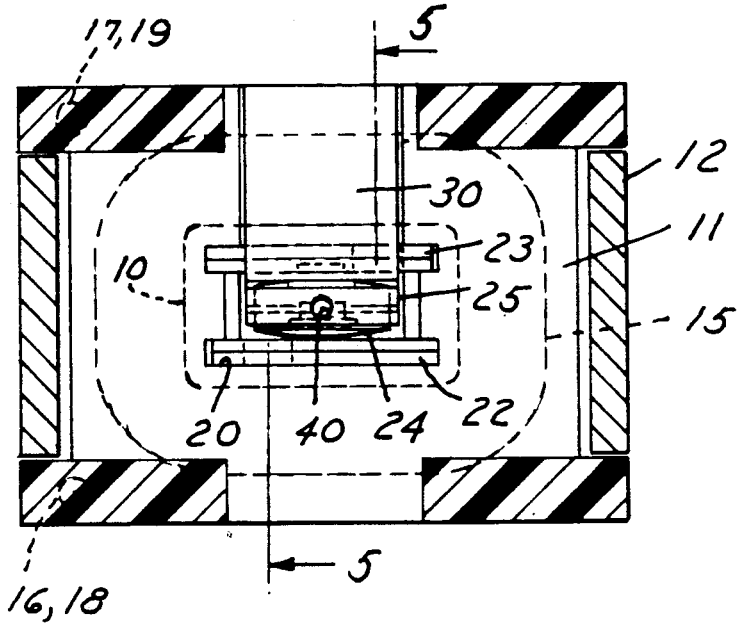
FIG. 4 is a fragmentary sectorial view on an enlarged scale taken along the line 4—4 in FIG. 1.
Figure 5:
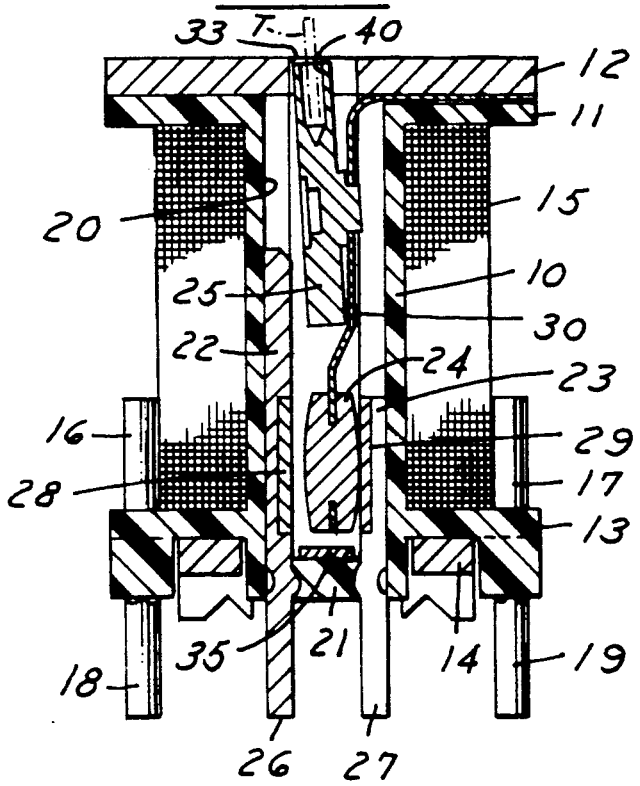
FIG. 5 is a sectional view taken along the line 5—5 in FIG. 4.

Referring to FIGS. 1–5, the relay of the present invention is of general elongated rectangular form with rounded corners. In a preferred commercial embodiment of the invention which is adapted for application to printed circuit boards for use in computer and other electronic circuits, the overall dimensions of the switch 1 excluding the terminals, are, say, 0.700 inch in height, along the axis of the coil, 0.770 inch long and 0.535 inch wide. The assemblage includes a bobbin 10 of insulating material, comprising a rigid plastic, such as nylon. This has a recessed spool portion having external dimensions 0.2 inch wide, 0.4 inch long, and 0.49 high along the axis. The spool portion is sandwiched between rectangularly-disposed end flanges 11, 13 which may be, say, 0.55 inch wide, 0.77 inch long, which are generally rectangular with rounded corners. The upper flange 11, of which the central portions are 0.031 inch thick, is increased in thickness at each of its corners to form a plurality of rectangular raised tabs 11*a* which serve as fastenings to accommodate the U-shaped magnetic return strap 12.

The lower flange 13 of bobbin 10 is about twice as thick around its inner and outer peripheries and is recessed in the intervening areas on its lower surface to accommodate a heel plate 14, in a manner shown in the drawings.

An electrical coil 15 comprising a number of layers of insulated copper magnet wire, is wound onto the bobbin 10 in a conventional manner, and terminates at its respective ends in a pair of terminal posts 16 and 17, which are rigidly fastened normal to the inner surface at opposite positions on the flange 13 at the lower end of spool of bobbin 10, being connected to the respective terminal posts 18, 19 which extend vertically downward, say, 0.22 inch from its lower surface.

The internal cavity 20 of the coil 15 in the present embodiment is, say, 0.15 inch wide, 0.35 inch long, and 0.57 inch along the axis of the coil, and terminates at its lower end in a flat insulating closure 21, which is 0.05 inch thick, and is integral with the extended inner walls of the cavity. The cavity 20 encloses the normally-open and normally-closed contacts 22 and 23 which are located in diametrically-opposite positions on the walls of the cavity, and the intervening spring-biased common terminal 24, to which is connected the magnetic armature 25.

In the present embodiment, the normally-open and normally-closed contact posts 22 and 23 comprise elongated rectangular members of low carbon steel and of brass, respectively, which are, say 0.35 inch wide and 0.025 inch thick, being fastened near the center of the cavity 20, as measured along the coil length, to opposite positions on its inner walls. The contact posts 22 and 23 are extended in the direction of the coil axis, with their lower ends terminating in the respective terminals 26 and 27 of reduced cross-section, which are anchored in and extend externally downward from the lower surface of the insulating closure 21. The contact post 22 extends 0.38 inch to its upper end from the lower end of cavity 20. Centered along the length of post 22 about 0.12 inch from the lower end of the cavity 20 is a contact member 28 comprising a silver inlay mounted in steel, which is, say, 0.0125 inch thick, 0.16 inch parallel to the axis of the coil, and, say, 0.35 inch wide perpendicular to the coil axis.

The contact post 23 extends 0.2 inch to its upper end above the lower end of cavity 20. A contact member 29 comprising a silver edge lay in brass corresponds in composition and size to the inlay contact member 28, and is disposed on terminal 23 exactly opposite the latter Inlay and edge lay 28 and 29 provide the bases for engaging opposite faces of the common contact 24. The latter comprise a pair of silver buttons, semispheroid in form, which extend out, say, 0.03 inch in diametrically-opposite directions from the lower face of the common contact arm 30. The latter comprises a flat leaf spring of, for example, a beryllium copper alloy, about 0.2 inch wide and 8 mils thick, the lower leg of which supports the double-faced contacts 24, and which leg extends upward therefrom, parallel to the axis of bobbin 10, for about 0.2 inch, at which plane it is bent through about a 45° angle, extending 0.05 inch in the direction of the contact post 23, and then again being bent upward, extending about 0.3 inch to the upper end of the cavity 20.

At its upper end, spring 30 is bent through a circular arc configuration, so that the upper outwardly-directed arm forms about an approximate 90° angle with the lower portion, to provide an anchor which fits over the upper face of flange 11 of the bobbin 10, being welded to the under surface of the U-shaped strap 12, as described hereinafter.

Secured to the outer face of the spring 30 above the 45° bend, is the magnetic armature 25, which is a rectangular member of low carbon steel. In the present embodiment this is, say, a little over 0.3 inch long, 0.2 inch wide and, say, 0.05 inch thick.

The U-shaped strap 12, which is formed from a sheet of low carbon steel, say, 0.05 inch thick is 0.77 inch in overall length across the top, and 0.4 inch wide, except for the centered lateral tabs 31 and 32, connected to sides which are 0.35 inch wide and extend out 0.05 inch on each side. These are designed to fit into and dovetail with the upper surface of end flange 11, so as to be flush with the bosses 11*a* on the corner surfaces. This arrangement serves to hold the U-frame 12 securely in place on end flange 11, and in secure contact with the upper surface of the upper end of the spring 30 which supports the central double-headed contact 24.

The top of the U-shaped strap 12 also includes a central rectangular opening 33, which is 0.08 inch wide and 0.2 inch long, which accommodates the upper end of the armature 25, when the spring member 30 is fastened in place between the upper surface of flange 11 and the under surface of the top of U-shaped strap 12. The opposite sides of U-shaped low carbon steel strap 12, which are, say 0.35 inch wide, extend down about 0.7 inch on each side, and terminate in tabs 34 which lock into place on the rectangular heel plate 14. The latter is, say, 0.52 inch wide and 0.65 inch long and 0.05 inch thick, and has edge slots which are designed to accommodate and mate with the tabs 34 on the U-shaped strap 12. Heel plate 14 has an additional edge slot 34*e* which accommodates the terminal 12*b*, which is connected ultimately to the double-headed central contact 24. Heel plate 14 also has a rectangular central opening which is 0.2 inch wide and 0.25 inch long, which is designed to seat in the lower surface of end flange 13 and to accommodate the lower end walls of the cavity 20, which are connected by the insulating platform 21 which is, say, 0.05 inch thick. The latter provides central openings, as shown on FIG. 5, which accommodate terminals 26 and 27 which are respectively connected to the normally-open and normally-closed relay contacts 28 and 29.

Typical operating parameters for relays of the type described in the following paragraphs and as follows.

Typical Specifications

1.
Coil Voltage: 12 V D
Coil Current: 200 Milliamperes Max
Contact Configuration: SPDT
Contact Current Rating: 30 Amperes Inductive
Expected Life: 75,000 Operations
Duty: Continuous
Coil Resistance: 60 ohms 2.
Coil Voltage: 24 VDC
Coil Current: ½ Amperes Max
Contact Configuration: SPST NO
Contact Current Rating: 5 Amperes Resistive
Expected Life: 6,000 Cycles
Duty Intermittent: 5 Seconds on (max) 20 Seconds Off (min)
Coil Resistance: 65–75 ohm A permanent magnet 35, which may comprise a rectangular member of a highly magnetic material such as, for example, ALNICO, which is a trademark for a magnetic material having aluminum, nickel, and cobalt as its principal ingredients, is interposed into the base of the cavity 20, resting on the insulating platform 21, below the plane of the contacts 22, 23 and 24. The ends of the permanent magnet 35 are insulated from the contact poles 22, 23 by strips of electrically insulating plastic such as that known by the trademark MYLAR, or other similar materials. In the alternative, the magnet 35 can be formed of non-conducting magnetic material, such as a permanent magnet formed from ceramic material. The magnet 35 may be selected from one of the many permanent magnetic materials available today, depending on the magnetic strength per unit volume, shock, temperature and resistance requirements.

Assume for a given size, the maximum degree of sensitivity has been accomplished, and that the relay requires 100 milliamperes to operate. Assume further that in a particular circuit the relay will be operated only a short time, and that it is possible for a given solid state component to drive five of these relays, and that such solid state component is only capable of delivering 300 milliamperes, instead of the 500 milliamperes which would normally be required. In such case, it is possible to increase the sensitivity of the relay of the present invention by augmenting the flux produced by the electromagnetic coil by the use of a permanent magnet, so designed and of sufficient magnitude, and of the proper polarity, that the flux of the permanent magnet aids the flux or the electromagnet. Thus, the added flux permits the resistance of the relay coil to be increased so as to draw a smaller current, e.g., 60 milliamperes, which, with the addition of the flux of the permanent magnet, is now able to operate the relay in the specific case cited, wherein the five relay load is 300 milliamperes, and within the current carrying capability of the solid state driving component.

Assume further that the five relays in the previous example are to be operated for an extended period, and that the solid state driving element can only handle the 300 milliampere requirement for, say, 10 milliseconds. In such case, the permanent magnet is designed to have sufficient strength to hold the relay energized, but not to operate it, as it is well known that relays require considerably less energy to hold-in than to operate. Thus, a short pulse of current of the proper polarity through the coil to aid the flux emanating from the permanent magnet functions to operate the relay; and when the pulse disappears, the relay continues to hold-in by virtue of the flux of the permanent magnet. In order to unlock the relay, a pulse generating flux of opposite polarity is required.

In accordance with the invention, the magnetic armature 25 is constructed and arranged such that it is accessible from the exterior of the enclosed relay to adjust the position of the spring-biased contact of the relay after it is assembled to conform with the desired level of voltage required to actuate the relay. Specifically, the magnetic armature 25 is provided with an opening 40 in the armature 25 extending to the exterior of the housing longitudinally of the armature 25 such that a small tool T, such as a pin, can be inserted to move the armature 25 and apply force laterally to change slightly the angular relationship of the spring 30 and, in turn, the flexible contact 24 which is fixed to the armature 25 and thereby adjust the voltage required to actuate the relay, while observing the voltage on an electronic instrument.

It can thus be seen that in accordance with the invention, the encapsulated relay can be adjusted after assembly to insure that the relay will be actuated at the desired voltage.

I claim:

1. In an electromagnetic relay comprising a bobbin of insulating material comprising a hollow spool sandwiched between a pair of end flanges, said spool and said end flanges defining a cavity centered along the principal axis of said spool; a coil of electrically conducting wire wound around said spool and forming therewith an electromagnet constructed, upon energization of said coil to generate a stream of magnetic flux in said cavity directed along said axis; at least one fixed electrical contact rigidly attached to an inner wall of said cavity; at least one movable contact; means for suspending said movable contact in said cavity, adjacent to said fixed contact; a magnetically actuable armature connected to said movable contact suspending means, and responsive to the flow of flux in said cavity to move said movable contact from a first position in open relation to said fixed contact, to a second position in closed relation with said fixed contact; means comprising a magnetically permeable enclosure surrounding opposite sides of said coil externally for completing the magnetic circuit for said flux, wherein said magnetically permeable enclosure is electrically connected to said means for suspending said movable contact, and is magnetically connected to provide a magnetic flux path to said armature; and said movable contact comprising spring-biasing means anchored to said magnetically permeable enclosure, the improvement wherein the magnetic armature includes means forming a cavity accessible from the exterior constructed and arranged such that said cavity is accessible from the exterior of the enclosed relay to adjust the relay after it is assembled to conform with the desired level of voltage required to actuate the relay.

2. The relay set forth in claim 1 wherein said cavity comprises an opening in the armature extending longitudinally of the armature and accessible from the exterior for receiving a tool to move the armature and thereby adjust the position of the spring-biased contact.

3. The method of adjusting an electromagnetic relay after it has been assembled wherein the relay comprising a bobbin of insulating material comprising a hollow spool sandwiched between a pair of end flanges, said spool and said end flanges defining a cavity centered along the principal axis of said spool; a coil of electrically conducting wire wound around said spool and forming therewith an electromagnet constructed, upon energization of said coil to generate a stream of magnetic flux in said cavity directed along said axis; at least one fixed electrical contact rigidly attached to an inner wall of said cavity; at least one movable contact; means for suspending said movable contact in said cavity, adjacent to said fixed contact; a magnetically actuable armature connected to said movable contact suspending means, and responsive to the flow of flux in said cavity to move said movable contact from a first position in open relation to said fixed contact, to a second position in closed relation with said fixed contact; means comprising a magnetically permeable enclosure surrounding opposite sides of said coil externally for completing the magnetic circuit for said flux, wherein said magnetically permeable enclosure is electrically connected to said means for suspending said movable contact, and is magnetically connected to provide a magnetic flux path to said armature; and said movable contact comprising spring-biasing means anchored to said magnetically permeable enclosure, said method comprising providing means on said magnetic armature forming a cavity accessible from the exterior such that said armature is accessible from the exterior of the enclosed relay, and engaging said cavity to adjust the spring-biased contact of the relay after it is assembled to conform with the desired level of voltage required to actuate the relay.

4. The relay set forth in claim 3 wherein said step of providing access to said armature comprises forming an opening in the armature extending longitudinally of the armature and accessible from the exterior for receiving a tool to move the armature and thereby adjust the position of the spring-biased contact.

* * * * *